US011993873B2

(12) United States Patent
Tibbits et al.

(10) Patent No.: US 11,993,873 B2
(45) Date of Patent: May 28, 2024

(54) REVERSIBLE TEXTILE TRANSFORMATION

(71) Applicants: Massachusetts Institute of Technology, Cambridge, MA (US); Ministry of Supply Inc., Boston, MA (US)

(72) Inventors: Skylar J.E. Tibbits, Boston, MA (US); Jared Smith Laucks, Somerville, MA (US); Schendy G. Kernizan, Milton, MA (US); Lavender Rose Tessmer, Cambridge, MA (US); Carmel Marie Dunlap, Somerville, MA (US); Gihan S. Amarasiriwardena, Somerville, MA (US)

(73) Assignees: Massachusetts Institute of Technology, Cambridge, MA (US); Ministry of Supply Inc., Boston, MA (US)

( * ) Notice: Subject to any disclaimer, the term of this patent is extended or adjusted under 35 U.S.C. 154(b) by 552 days.

(21) Appl. No.: 17/016,149

(22) Filed: Sep. 9, 2020

(65) Prior Publication Data

US 2021/0071326 A1 Mar. 11, 2021

Related U.S. Application Data

(60) Provisional application No. 62/897,955, filed on Sep. 9, 2019.

(51) Int. Cl.
*D04B 1/16* (2006.01)
*D04B 1/22* (2006.01)

(52) U.S. Cl.
CPC ..... *D04B 1/16* (2013.01); *D04B 1/22* (2013.01); *D10B 2401/04* (2013.01); *D10B 2403/0114* (2013.01)

(58) Field of Classification Search
CPC ..... D04B 1/16; D04B 1/22; D10B 2401/04; D10B 2403/0114
See application file for complete search history.

(56) References Cited

U.S. PATENT DOCUMENTS 4,199,633 A 4/1980 Blore
4,784,909 A * 11/1988 Emi ..... A46D 1/00 428/397

(Continued)

FOREIGN PATENT DOCUMENTS

WO WO 2017/165435 A2 9/2017
WO WO 2020/106389 A1 5/2020

OTHER PUBLICATIONS

Ramgulam, R.B., "Modelling of knitting," Chapter 3 in "Advances in Knitting Technology," pp. 48-85 (2011).

(Continued)

*Primary Examiner* — Danny Worrell
(74) *Attorney, Agent, or Firm* — Hamilton, Brook, Smith & Reynolds, P.C.

(57) ABSTRACT

Knit textile structures are formed of a yarn made of composite fibers, which is an active material within the knit structure that transforms in response to a change in temperature. In combination with non-active fibers and performative knit structure, this contraction can enable changes in the fabric that are adaptive to changes in environmental conditions during wear.

11 Claims, 21 Drawing Sheets

(56) References Cited

U.S. PATENT DOCUMENTS

| | | | | |
|---|---|---|---|---|
| 5,087,519 | A * | 2/1992 | Yamaguchi | D06M 15/333 428/397 |
| 5,108,820 | A * | 4/1992 | Kaneko | D01F 8/06 442/361 |
| 6,248,445 | B1 * | 6/2001 | Yamakawa | D01F 8/12 428/397 |
| 6,767,498 | B1 * | 7/2004 | Talley, Jr. | D04H 3/02 264/210.8 |
| 7,179,412 | B1 | 2/2007 | Wilkie et al. | |
| 7,740,777 | B2 | 6/2010 | Wilkie et al. | |
| 2004/0214495 | A1 | 10/2004 | Foss et al. | |
| 2007/0270067 | A1 * | 11/2007 | Yasui | D04B 1/16 442/308 |
| 2008/0132133 | A1 * | 6/2008 | Yasui | D03D 15/283 442/200 |
| 2009/0159149 | A1 | 6/2009 | Karayianni et al. | |
| 2012/0279260 | A1 * | 11/2012 | Dua | D04B 21/08 66/171 |
| 2017/0175719 | A1 | 6/2017 | Asai | |
| 2018/0195213 | A1 | 7/2018 | Tibbits et al. | |
| 2018/0245249 | A1 | 8/2018 | Yenici et al. | |
| 2020/0165122 | A1 | 5/2020 | Salzmann | |
| 2021/0198817 | A1 | 7/2021 | Göktepe et al. | |
| 2021/0310162 | A1 | 10/2021 | Tibbets et al. | |

OTHER PUBLICATIONS

Smith et al., "Textiles in perspective," Prentice-Hall, Inc., pp. 182-183 (1982).

Active Textile Tailoring on Vimeo, Self-Assembly Lab, MIT (Nov. 1, 2018).

* cited by examiner

Trial 1
PP | PET + PIGMENT
72 filaments
50/50 cross section

40/60 cross section

60/40 cross section

Trial 2
PA6 | LLDPE
72 filaments

Trial 2
PA6 | LLDPE + PIGMENT
72 filaments, 36 filaments

Trial 3
LLDPE | LLDPE + PIGMENT
72 filaments

Trial 4
LLDPE | LLDPE + PIGMENT
Monofilament

Trial 5
PA6 | PA6 + PIGMENT
72 filaments

No Twist

Balanced Twist

Unbalanced Twist - Z only

Unbalanced Twist -
Alternating Rows of S and Z

Single-Jersey Vents

Fabric Face - Before Activation

Cross Section - Before Activation

Fabric Face - After Activation

Cross Section - After Activation

Fabric Face - Before Activation

Cross Section - Before Activation

Fabric Face - After Activation

Cross Section - After Activation

Front Fabric Face

Back Fabric Face

REVERSIBLE TEXTILE TRANSFORMATION

RELATED APPLICATION

This application claims the benefit of U.S. Provisional Application No. 62/897,955, filed on Sep. 9, 2019. The entire teachings of the above application are incorporated herein by reference.

GOVERNMENT SUPPORT

This invention was made with Government support under Grant No. W15QKN-16-3-0001 awarded by the Department of Defense. The Government has certain rights in the invention.

BACKGROUND

Garments are traditionally designed for single environments and use-cases. Thus, people often add a supplementary garment or jacket if they are cold. Alternatively, people change clothes if they become too hot. Similarly, garments are not designed to be worn in multiple use cases, such as biking and working. Generally speaking, the ventilation and breathability of a garment are static and do not change as ambient temperature or body temperature increase or decrease.

SUMMARY

Described herein are textiles and garments that can self-transform to adapt to changes in the environment. In particular, described herein are methods of making active textiles with fiber/yarn compositions and knit structures that promote a bi-directional material transformation based on temperature activation. Examples of bi-directional material transformations include inducing a physical shape or porosity change.

Described herein are knit textile structure with composite fibers incorporated into the fabric. The composite fibers self-transform based on changes in temperature. The composite fibers cause a local change in the structure of the knit, causing it to expand or contract. In combination with non-active (non-composite) fibers and performative knit structure, this contraction can enable changes in the fabric that are adaptive to changes in environmental conditions during wear. The garment can have zonal placement of composite fibers and non-composite fibers as well as zonal activation to control the location, amount and type of transformation in the garment. The precise design of multiple material properties, cross-section shape/color/ratios in multi-component fibers, twist, post processing and knit structure can be used to design the bi-directional transformation of textiles. The integration of active fiber in knit fabric greatly improves the properties of static fiber in response to changes in temperature.

Described herein is a yarn. The yarn includes a plurality of fibers that are composites of first and second polymers arranged side-by-side in cross-section. The first polymer includes a pigment. The first or second polymer can be polypropylene (PP), polyethylene terephthalate (PET), polyethylene (PE), or polyamide (PA). The first polymer can be polyethylene terephthalate or polyethylene. The first and second polymers can be the same polymer. The first polymer can absorb more infrared radiation than the second polymer. The pigment of the first polymer can be a color other than white. The pigment of the first polymer can be black in color.

The pigment of the first polymer can be amorphous carbon black. The second polymer can include a pigment. The pigment of the second polymer can be white in color. A cross section of the fibers can include a greater amount of the first polymer than the second polymer. The fibers can have a circular cross section. The first and second polymers can have linear coefficients of thermal expansion that differ from $1\times10^{-5}$/° C. to $20\times10^{-5}$/° C. at room temperature, preferably from $5\times10^{-5}$/° C. to $15\times10^{-5}$/° C. at room temperature. The first and second polymers can have linear coefficients of thermal expansion that differ by at least $1\times10^{-5}$/° C. at room temperature, preferably by at least 5×10−5/° C. at room temperature, even more preferably by at least $1\times10^{-5}$/° C. at room temperature.

Described herein is a knit fabric. The knit fabric includes a first and second yarn knit together. At least one of the first and second yarns includes a plurality of fibers that are composites of first and second polymers arranged side-by-side in cross-section. The first polymer can include a pigment. The plurality of fibers of the first yarn can have an S twist. The plurality of fibers of the second yarn can have a Z twist. The first and second polymers can be the same polymer. The first and second yarns can be knit in an alternating arrangement. Pairs of the first and second yarns can be knit in an alternating arrangement. The first and second yarns can be knit together with a third yarn that is not a composite material. The first and second yarn can be knit together to form a single jersey fabric.

Described herein is a knit fabric. The knit fabric includes a first and second yarn knit together to form a fabric having a front face and a back face. The first yarn is not a composite material. The second yarn includes a plurality of fibers that are composites of first and second polymers arranged side-by-side in cross-section. The first polymer includes a pigment. A region of the knit fabric can have the first yarn on the front face and the second yarn on the back face. A cross-section of the knit fabric can have a plurality of alternating regions, wherein a first region has the first yarn on the front face and the second yarn on the back face, which is adjacent to a second region having the first yarn on the back face and the second yarn on the front face. The region can be square in shape. The first fabric can be cotton.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIG. 3A illustrates no twisting. FIG. 3B illustrates a balanced twist. FIG. 3C illustrates an unbalanced twist—Z only. FIG. 3D illustrates an unbalanced twist—alternating rows of S and Z twist.

FIG. 5A is a photograph of single jersey vents before activation. FIG. 5B is a schematic of the cross-section of the single jersey fabric before activation. FIG. 5C is a photograph of the single jersey vents after activation. FIG. 5D is a schematic of the cross-section of the single jersey fabric after activation.

FIG. 6A is the front face of the spacer fabric, which shows the inactive yarn. FIG. 6B is the back face of the spacer fabric, which shows the active yarn of composite fibers. FIG. 6C is the knit program showing the active and inactive yarns.

FIG. 7A is a photograph of the front face of the spacer fabric before activation. FIG. 7B is a schematic of the cross-section of the spacer fabric having vents before activation. FIG. 7C is a photograph of the front face of the spacer fabric after activation. FIG. 7D is a schematic of the cross-section of the spacer fabric having vents after activation.

FIG. 9A illustrates S-twist fabric. FIG. 9B illustrates Z-twist fabric. FIGS. 9C and 9D illustrate the front fabric face. FIGS. 9E and 9F illustrate the back fabric face.

DETAILED DESCRIPTION

A description of example embodiments follows.

Overview

Yarns of composite fibers can exhibit change in shape in response to a change in temperature. The composite fibers have first and second polymers, which are generally arranged side-by-side in cross-section. The ratio of first and second polymers in the cross-section, the color of the first and second polymers, and the type of polymer for the first and second polymers contribute to behavior of the yarn in response to changes in temperature.

In embodiments described herein the first polymer includes a pigment. The pigment causes the first polymer to be darker in color than the second polymer. Upon exposure to light, the first polymer absorbs more light energy than the second polymer, and consequently the first polymer heats up at a faster rate than second polymer.

Composite Fibers

In general, the fibers are composites of two or more polymers. Typically, the fibers are composites of two polymers. The two polymers are co-extruded to form a composite fiber. Composite fibers and methods of making composite fibers are described in U.S. Pat. Nos. 7,179,412 and 7,740,777.

Figure 1:
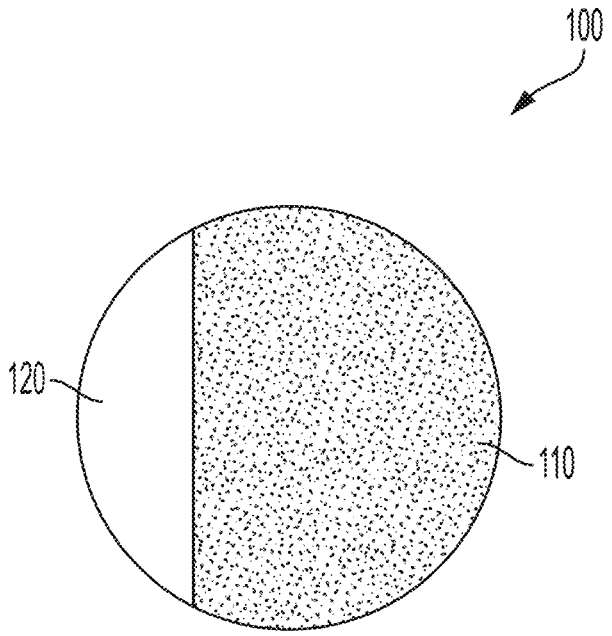
FIG. 1 illustrates a cross-section of a composite fiber.

FIG. 1 illustrates a cross-section of a composite fiber 100. The composite fiber 100 includes a first polymer 110 and a second polymer 120.

The first polymer 110 includes a pigment, which is typically a dark color. Optionally, the second polymer 120 can include a pigment, but the pigment of the second polymer is typically a light color, such as white. Adding a light (white) color pigment to the second polymer contributes to differential absorption of light, causing the first polymer to heat up at a faster rate than the second polymer.

Cross Section of Composite Fibers

The cross section shape and ratio of first and second polymers can be varied. One example is 10% polypropylene (PP) with 90% linear low-density polyethylene (LLDPE).

Preferably, the polymer containing the dark (non-white) pigment is greater than 50% of the cross-section of the fiber. In these embodiments, the response to exposure to light is more dramatic (e.g., greater change in structure). For example, creating a black LLDPE material cross-section combined with white PP amplifies the transformation effect. This selection of polymer, color and cross section shape/ratios can be tuned to create a bi-directional response that is within the activation temperature range and promotes reversible transformation in textiles.

The figures and examples pertain to fibers having a circular cross-section. However, fibers with many other cross-sections are suitable, such as square, rectangular, oval, star, and hour-glass.

In general, the polymers are arranged side-by-side in cross section. However, the side-by-side nature of the polymers is not a rigid requirement, as one of skill in the art will appreciate that the fiber extrusion process introduces natural variation in the cross-section over the length of a fiber.

Polymers

Composite fibers for temperature-based activation are formed of two or more polymers having different coefficients of thermal expansion (CTE). For example, linear low-density polyethylene (LLDPE), which has a high CTE value, and polypropylene (PP), which has a low CTE value, can be combined to create an active fiber. The cross-section can also be varied to create a bias between one of the materials and promote more force for transformation.

Many polymers are suitable for use in the composite fibers. Examples include nylon, nylon-6 (polyamide 6, PA6), nylon-6-6, polypropylene (PP), polyethylene terephthalate (PET), polytrimethylene terephthalate (PTT) and polybutylene terephthalate (PBT), polyethylene (PE), which can include high-density polyethylene (HDPE), linear low-density polyethylene (LLDPE), and high-molecular-weight polyethylene (HMWPE)), polyester, and acrylic.

In some cases, material such as HMWPE exhibit thermal contraction with rising temperature, which can be used to activate certain pore structures and geometries.

Pigments

The first polymer can include a pigment so that the first polymer is a color other than white. For example, the first polymer can include a pigment so that it is black, brown, red, orange, yellow, green, blue, indigo and violet, or any mixture thereof. Wavelengths of higher frequency result in darker colors, resulting in more absorbed heat. White objects absorb the least heat, followed by objects that are red, orange, yellow, green, blue, indigo and violet, which attracts the most heat of any visible color other than black. In some embodiments, the pigment of the first polymer is black in color. In some embodiments, the pigment of the first polymer is amorphous carbon black. A variety of black pigments are suitable, including Ampacet 49419 and Lamp Black 101-S. A variety of pigments for other colors are suitable as well.

In some embodiments, the second polymer can also include a pigment so that the second polymer is a lighter color than the first polymer. In some embodiments, the second polymer can include a white pigment, such as $TiO_2$ (also known as titanium white) (available as Americhem 64275). A variety of white pigments are suitable.

The pigments are introduced into the first and or second polymer during the composite fiber extrusion process, which is described in U.S. Pat. Nos. 7,179,412 and 7,740,777.

Activation Energy

The activation energy can come as single or multiple input for example, dry heat (−40° C.-500° C.), steam (e.g., from sweat), and ultraviolet, visible, and infrared radiation (e.g., from sunlight). Bi-directional change is ideal in the −20° C. to 50° C. range which encompasses normal operating environments for the wearer as well as the body-garment microclimate.

Yarns of Twisted Fibers

Fiber twist can be used to augment the intended behavior of the active material, and different twist configurations can be applied to untwisted fiber in order to maximize its active behavior within a knit structure. Furthermore, combinations of more than one twist condition can be used to produce additional active effects in the fabric. For instance, alternating S and Z-twisted unbalanced yarns can exaggerate active behavior of the fibers when combined inside the knit structure. Fiber twist level can be used to adjust the responsiveness of the fiber to temperature and moisture change. Twist can also be used in combination with heat setting to produce further behavior of the active fiber.

Figure 3A:
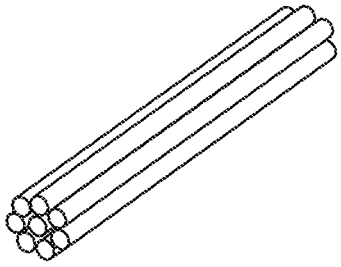
FIG. 3A-D illustrate twist conditions for yarns.
Figure 3B:
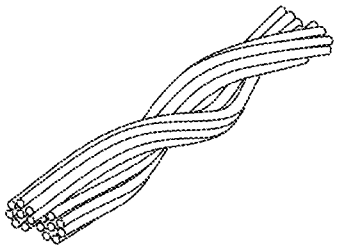
Figure 3C:
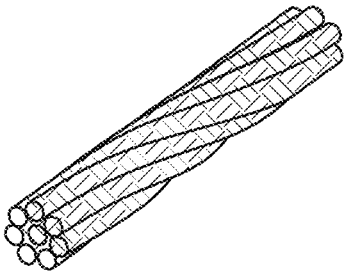
Figure 3D:
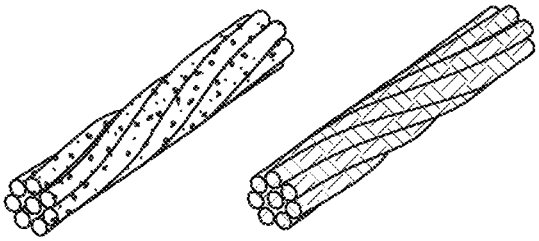

FIG. 3A-D illustrate twist conditions for yarns. FIG. 3A illustrates no twisting. FIG. 3B illustrates a balanced twist. FIG. 3C illustrates an unbalanced twist—Z only. An unbalanced yarn has twist energy and tends to untwist. A balanced yarn does not have twist energy, and therefore does not have a tendency to untwist. FIG. 3D illustrates an unbalanced twist—alternating rows of S and Z twist. In an S-twist yarn, the fibers follow a spiral pattern parallel to the center bar of the letter S. In a Z-twist yarn, the fibers are parallel to the center bar of the letter Z.

Non Active Material

A wide variety of non-active fibers/yarns (e.g., non-composite fibers) can be juxtaposed (knit with) with active (composite) yarns to gain control over zones, constrain certain regions, or amplify the effects of the transformation. Examples of zones are described at FIGS. 10-11 of WO 2020/106389 A1.

To amplify the transformation, a non-active (non-composite) yarn can be used which does not react to heat and continues to keep its form as the active (composite) yarn transforms. The non-active yarn can be made of cotton, polyester, rayon, tencel, and as well as 2nd generation synthetics, bio engineered silks, and bamboo etc.

Knit Structures

A myriad of knit structures can be used in combination with active and inactive fibers/yarns. A variety of primary-knit structures that exhibit controlled shape change have been used. A garment knitting pattern can be wholly composed of active knit structures, or consist of components of active structures in combination with inactive structures to create a macro-shape change.

Geometric Tessellation: Alternation of simple knit structures (e.g. jersey) in active (composite) yarn and non-active (non-composite) yarn can cause an accordion-like structure that expands or contracts based on temperature or moisture. Tessellation of triangles, trapezoids, rectangles, square, and other shapes can create a similar effect. FIGS. 5A-D illustrate tessellation of long, rectangular patches. FIGS. 7A-D illustrate tessellation of active (composite fibers) yarn 510 and inactive yarn 520 in a spacer fabric.

Figure 6C:
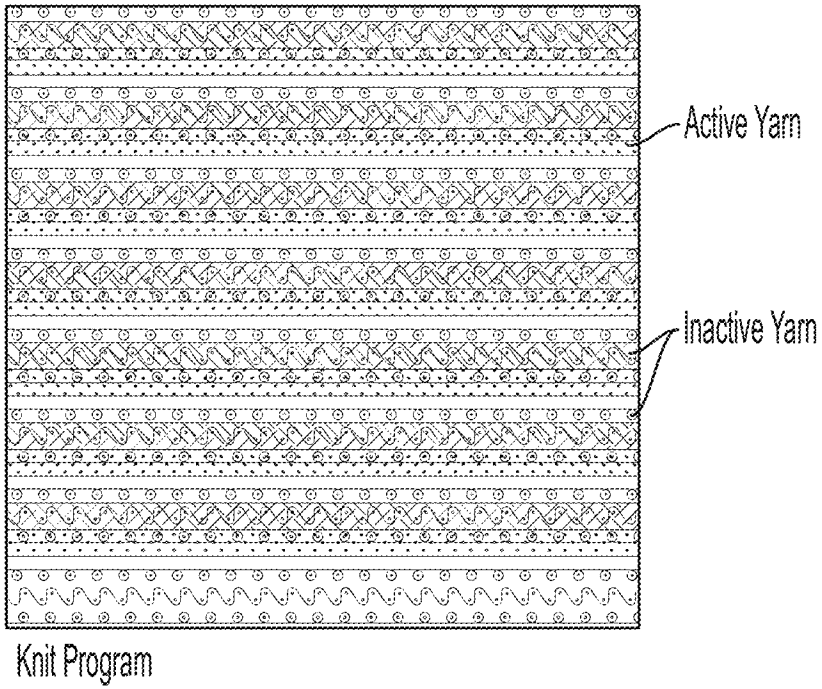
FIGS. 6A-C illustrate a spacer fabric with active (composite) yarn 410 and inactive (e.g., non-composite) yarn 420.
Figure 6B:
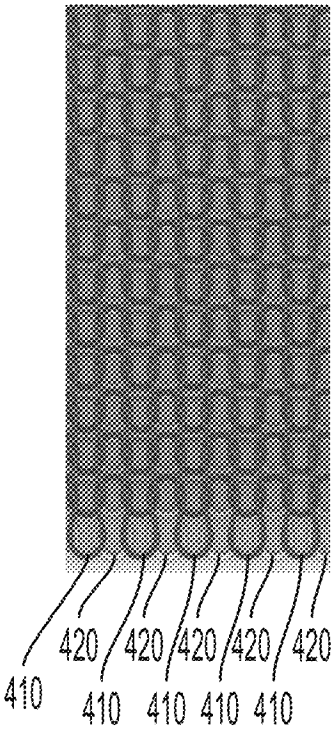
Figure 6A:
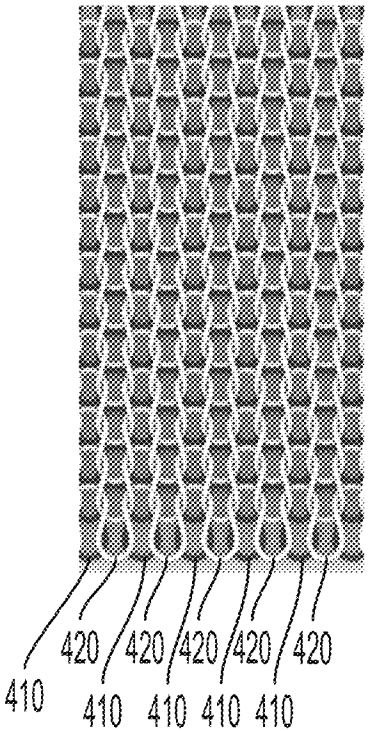
Figure 7A:
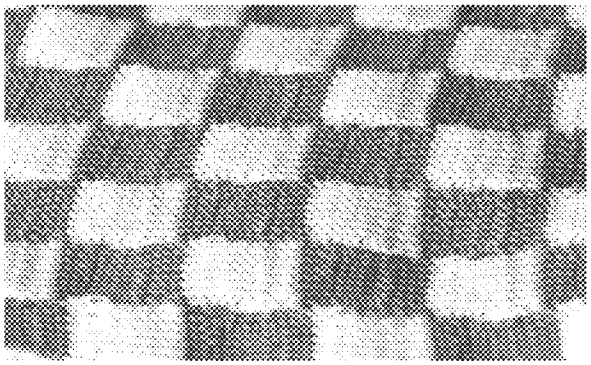
FIG. 7A-D illustrate a spacer fabric having vents.
Figure 7B:
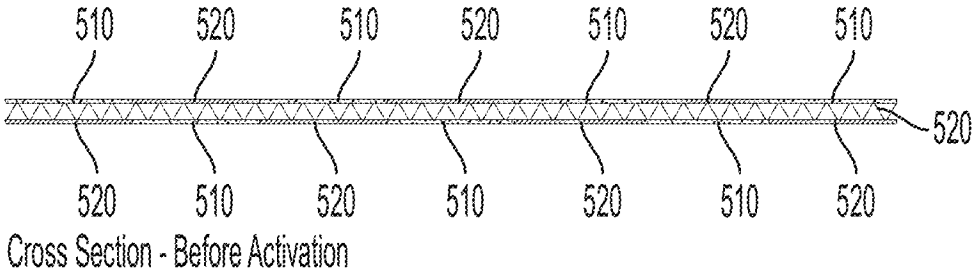
Figure 7C:
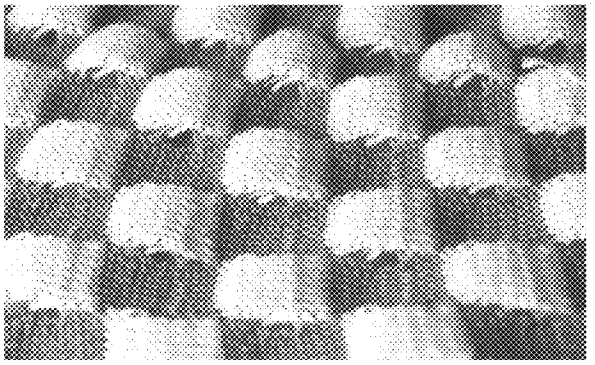
Figure 7D:
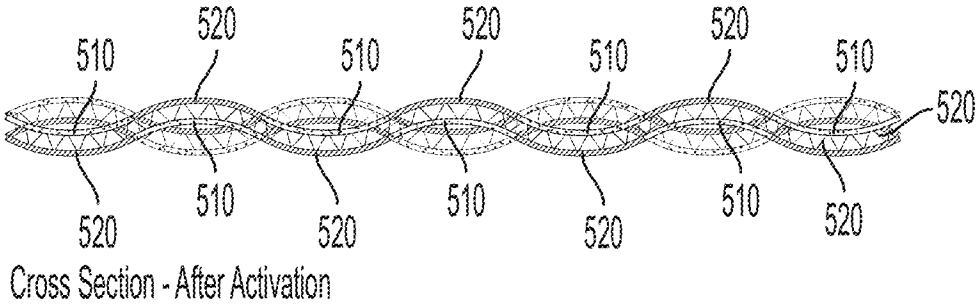
Figure 9A:
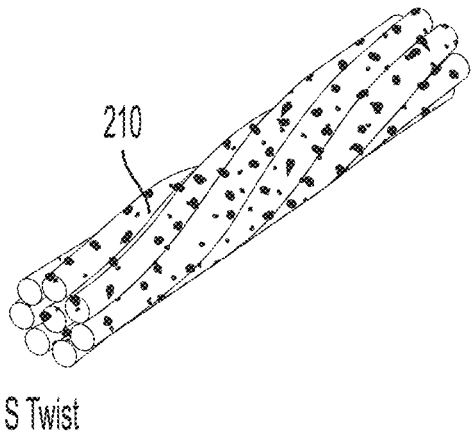
FIGS. 9A-F illustrate a spacer fabric with twist-alternated courses of composite yarn on one fabric face.
Figure 9B:
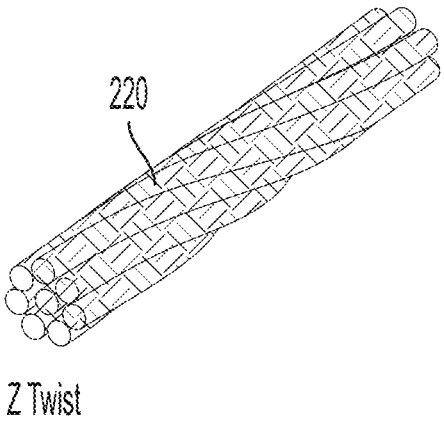
Figure 9C:
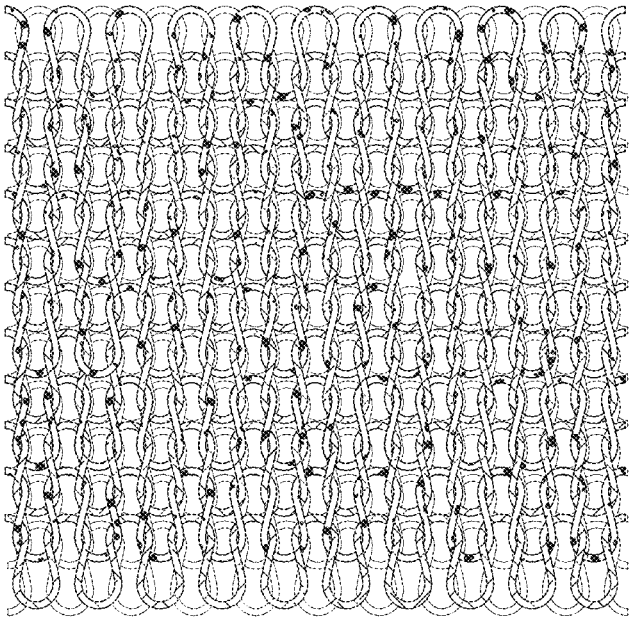
Figure 9D:
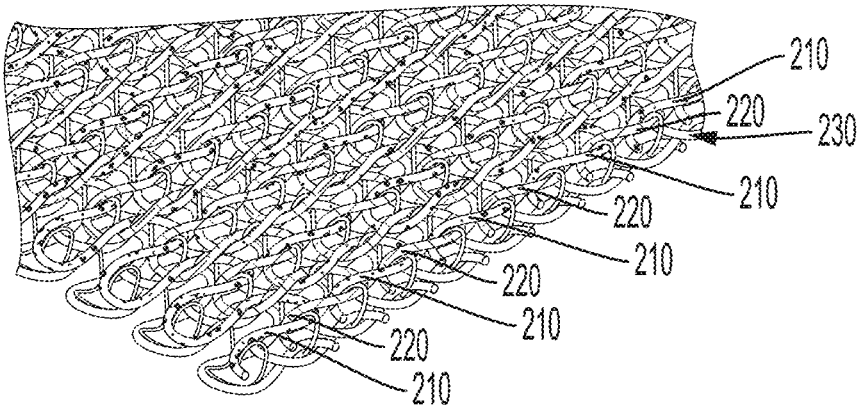
Figure 9E:
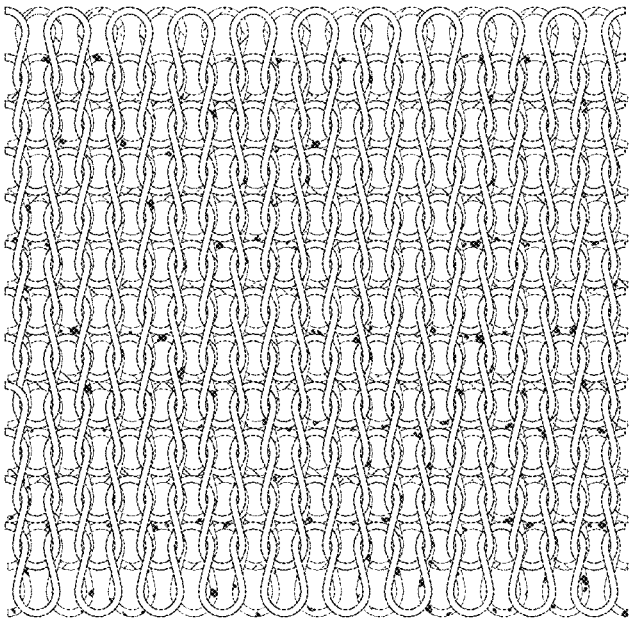
Figure 9F:
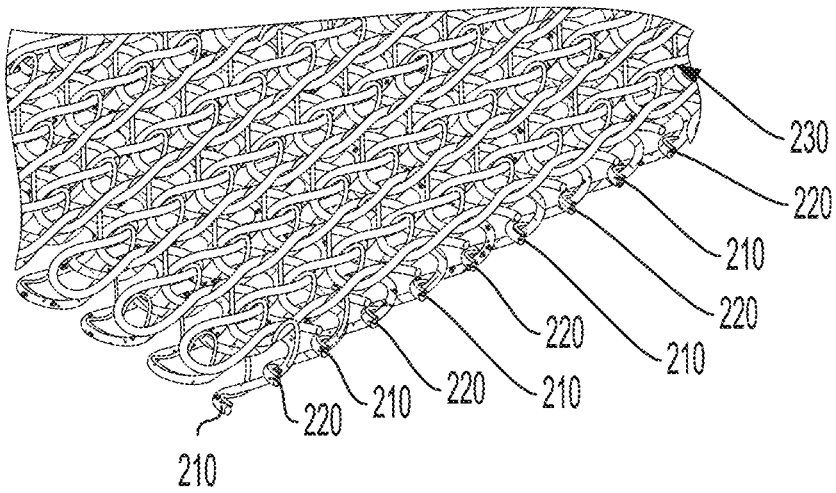

Spacer Fabric (FIGS. 6A-C): This knit structure can be used to separate the active (composite fibers) yarns 410 and inactive (e.g., non-composite fibers) yarn 420 opposite fabric faces, producing a curling effect when one fabric face exhibits a responsive behavior while the other face remains static. FIGS. 9A-F illustrate a spacer fabric with twist-alternated courses of S-twist composite yarn 210 and Z-twist composite yarn 220 on one fabric face. Inactive yarn 230 is applied to the opposite face of the fabric where the composite yarns are located; it is also used as an interstitial material to join the front and back fabric faces together. FIGS. 9C and 9D illustrate the front fabric face. FIGS. 9E and 9F illustrate the back fabric face.

Combined Structures: Any combination of these structures and geometries can be combined to create localized moisture and or thermal response in specific regions of a garment.

Figure 4:
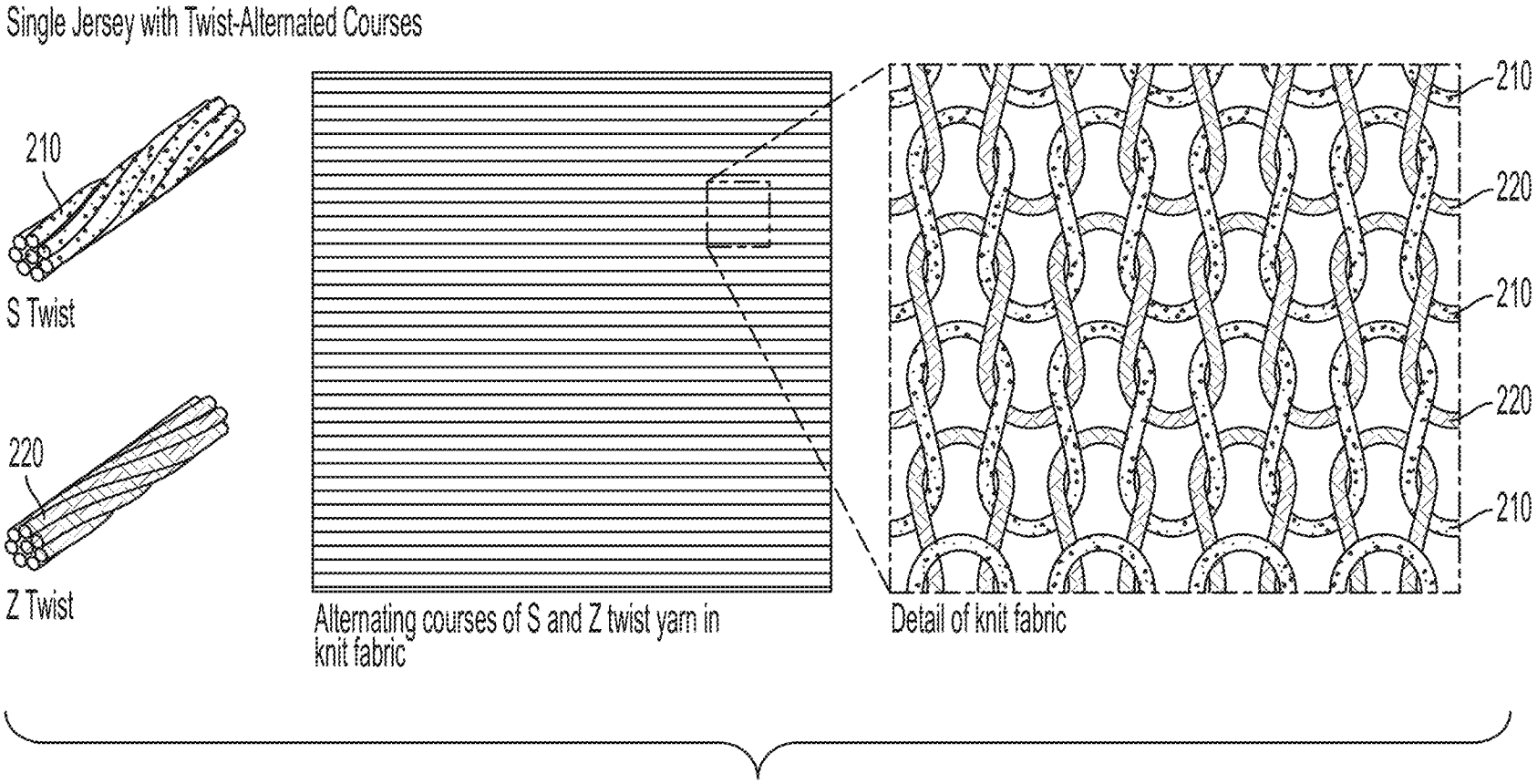
FIG. 4 illustrates a single jersey fabric knit from yarns of composite fibers.
Figure 5A:
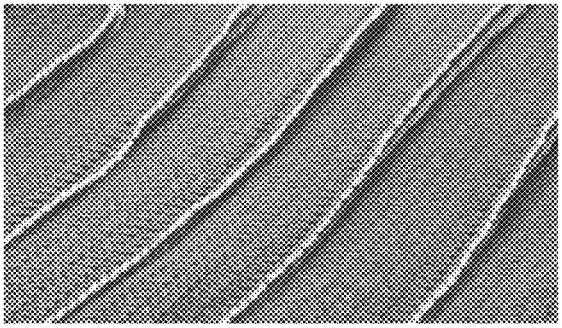
FIGS. 5A-D illustrate single jersey fabric forming vents.
Figure 5B:
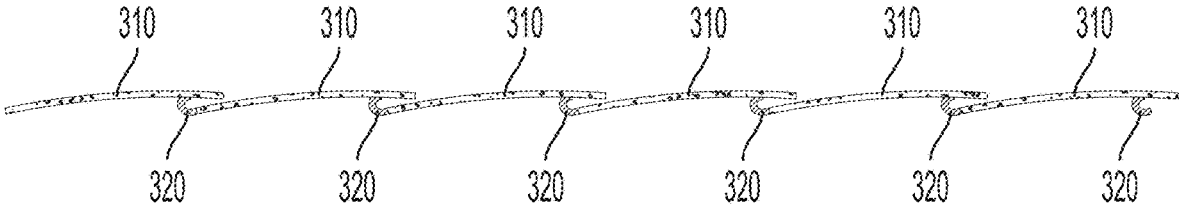
Figure 5C:
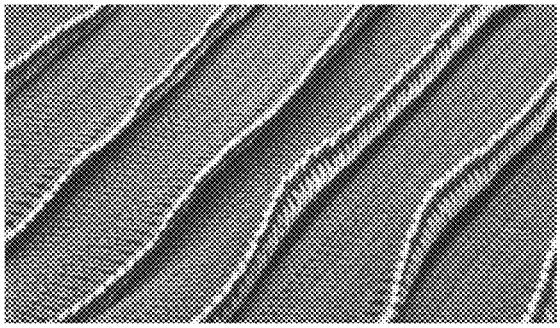
Figure 5D:
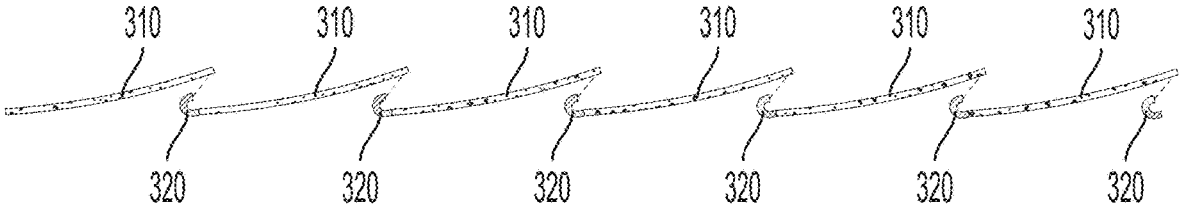

Another embodiment is a single jersey knit fabric, as in FIGS. 4 and 5A-D. Single jersey is weft knitted fabric which is formed by one set of needles. FIG. 4 illustrates alternating courses of S-twist yarn 210 and Z-twist yarn 220. FIGS. 5A-D illustrate active (composite) yarn 310 and inactive (non-composite) yarn 320.

Figure 8A:
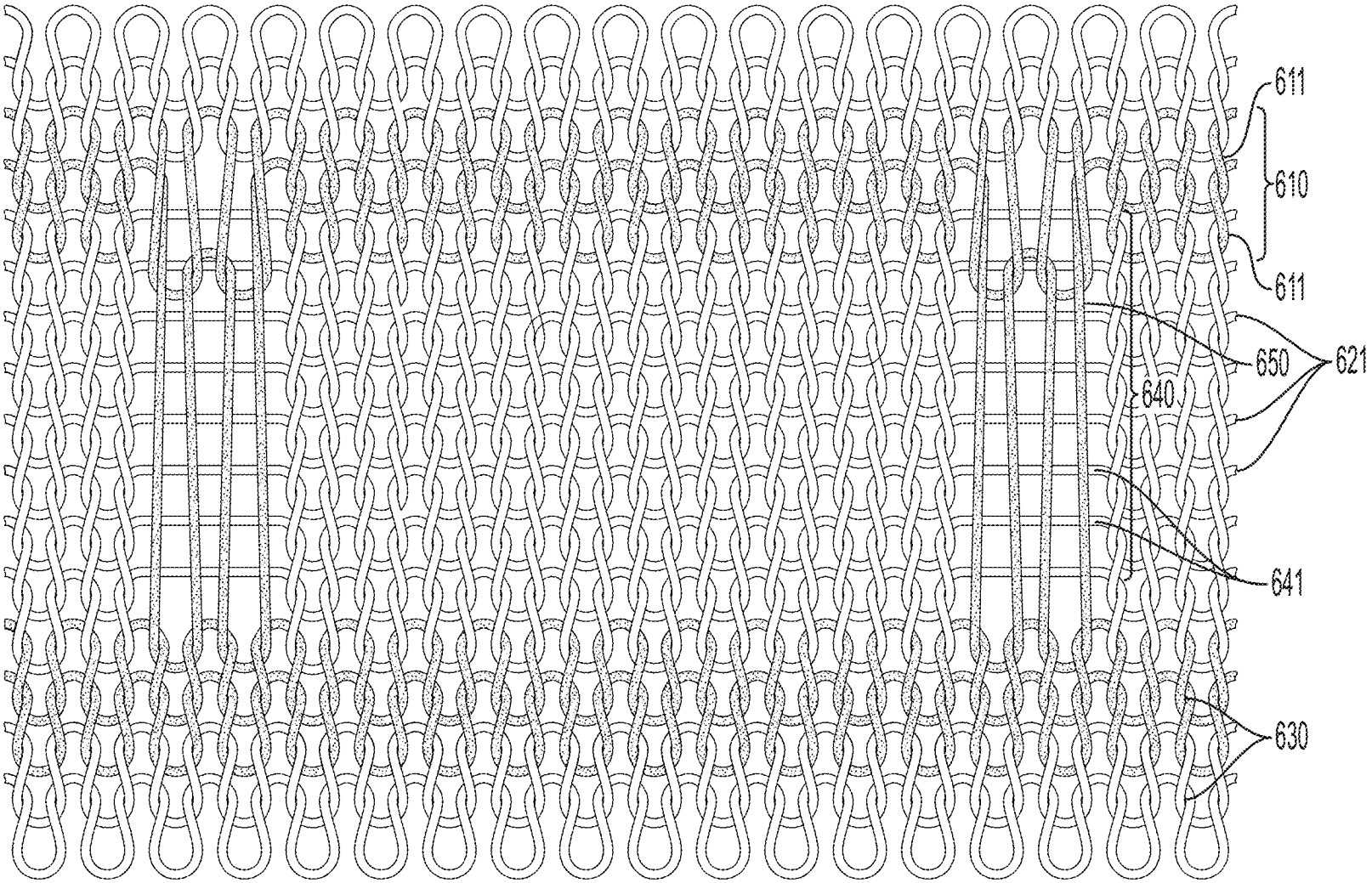
FIGS. 8A-C are textile patterns.

FIG. 8A is a textile pattern where the active material (composite fiber) is distributed in a grid where there are floated stitches in the inactive (non-composite) fiber and zero floated stitches in the active (composite) fiber. The active fiber is knitted in horizontal rows, where alternating sets of stitches of active fiber are held on the needles while the inactive fiber is knitted for a series of subsequent rows. This produces a series of elongated stitches where the fiber is held, maximizing the potential of the fibers to contract. When exposed to heat, the resulting pattern produces localized shrinkage in the fabric enabled by the large stitch sizes of the active material where the stitches have been held during knitting.

As illustrated in FIG. 8A, a first set of active fibers 610, formed of individual active fibers 611, are knit with inactive fibers 621. One of skill in the art will appreciate that the individual active fibers 611 can be formed of a single active fiber 611, which has been looped around in the stitching pattern. Similar, the individual inactive fibers 621 can be formed of a single active fiber 621. Plain stitches 630 are formed among the active fibers 611, among the active fibers 611 and inactive fibers 621, and among the inactive fibers 621. While the stitches 630 illustrated in FIG. 8A are jersey stitches, a wide variety of stitches are suitable. A set of horizontal floats 640 is formed of a plurality of individual horizontal floats 641 of the inactive fibers 621. In some cases, there is only one horizontal float 641. Across the set of horizontal floats 640, an elongated loop (held stitch) 650 is formed in the active fiber. As illustrated in FIG. 8A, there are two sets of active fibers 610, but more can be included. FIG. 8A illustrates eight floats 641 of the inactive fibers, but more or less can be included. More floats produces a greater transformation than fewer floats.

Figure 8B:
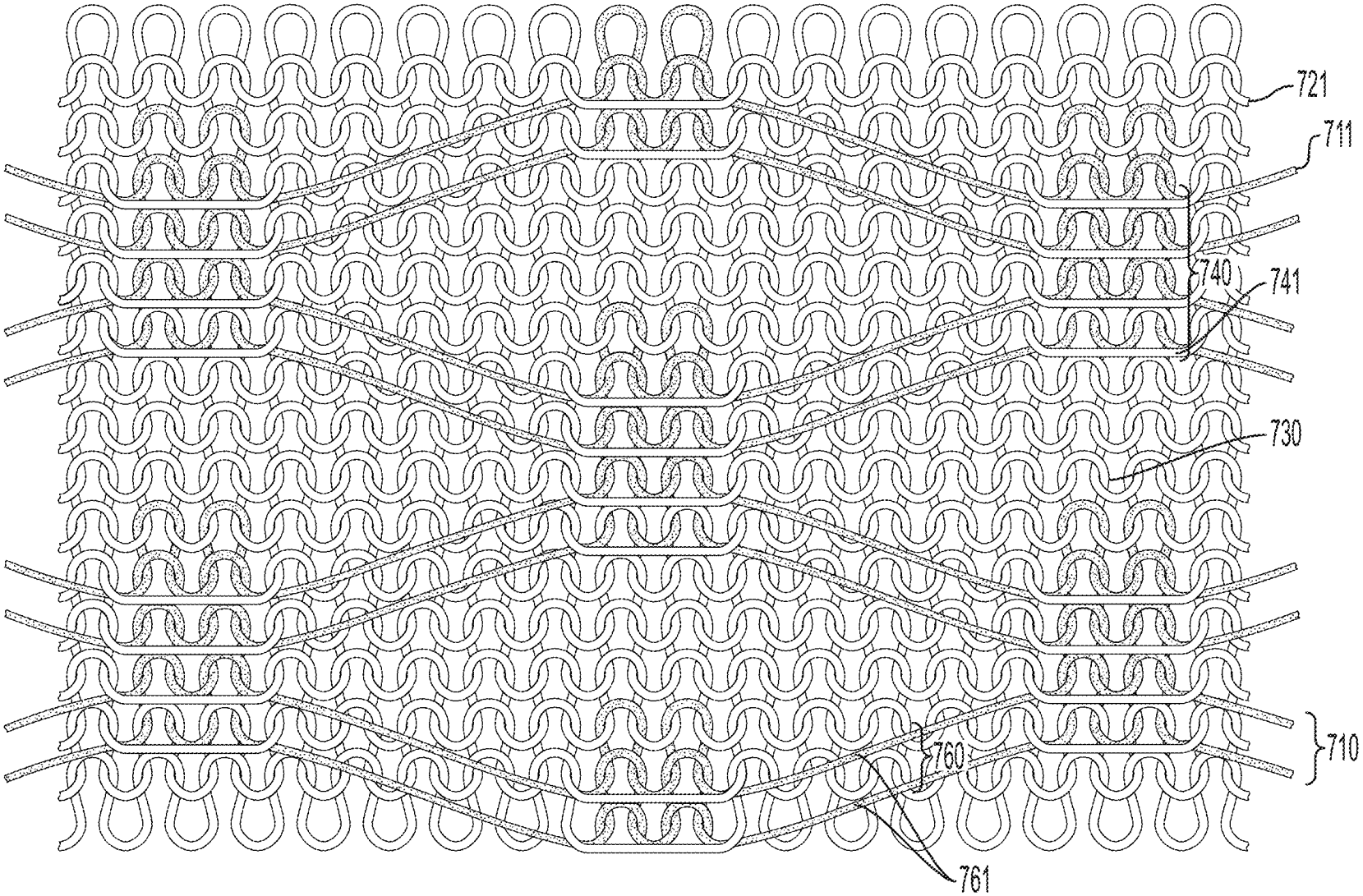

FIG. 8B is a textile pattern where the active (composite) material is knitted in small clusters of stitches that are interspersed through areas of inactive stitches. The active clusters are linked together with floats on the reverse side of the fabric that connect the active areas in a diagonal grid. When heat is applied to the material, the active floats contract to produce localized gathering in the inactive material. Floats are used to elongate the areas of active fiber, producing fabric contraction.

As illustrated in FIG. 8B, a textile can include one or more regions of active fibers that overlie (or underlie) one or more floats 741 of inactive fibers 721. FIG. 8B illustrates seven regions of active fibers that overlie (or underlie) one or more floats 741 of inactive fibers 721. A first region of active fiber stitching can overlie at least one float 741 of an inactive fiber 721. A second region of active fiber stitching can overlie at least one float 741 of an inactive fiber 721. An active fiber float 261 that overlies stitching inactive fibers 721 can connect, or join, the first region of active fibers to the second region of active fibers. A first set of active fibers 710, formed of individual active fibers 711, can be knit with inactive fibers 721. Stitches 730 are formed among the active fibers 711, among the active fibers 711 and inactive fibers 721, and among the inactive fibers 721. While jersey stitches 730 are illustrated, other types of stitches are suitable. A set of floats 740 is formed of a plurality of individual floats 741 of the inactive fibers. As illustrated, individual floats 741 are horizontal. Sets of floats 760 are formed of a plurality of individual diagonal floats 761 of the active fibers 711. As illustrated, the floats 761 extend diagonally, but the can extend vertically, horizontally, or at other angles.

Figure 8C:
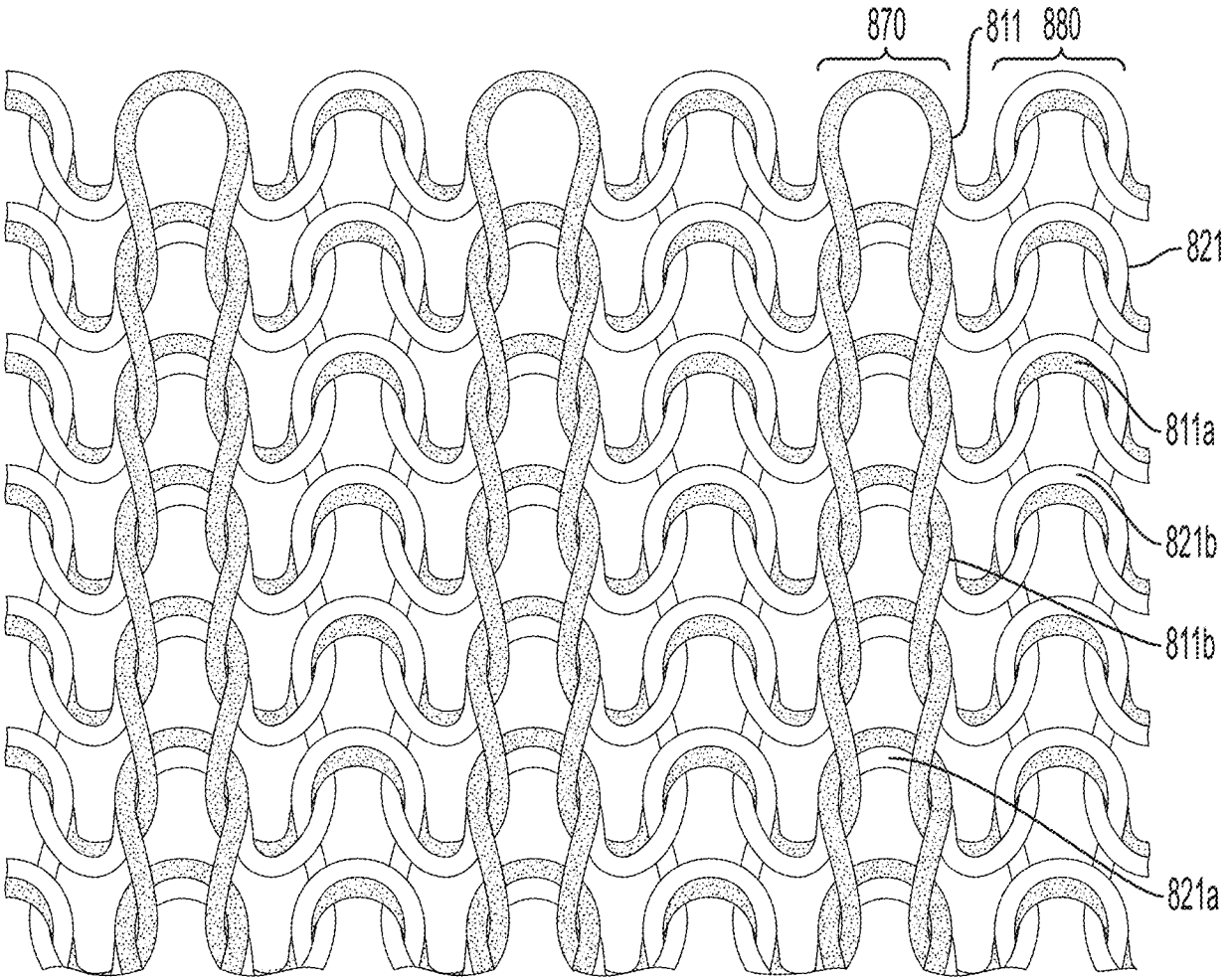

FIG. 8C is a textile pattern where the active material is applied to one fabric face, and inactive material is applied to the reverse face in a two-material rib knit structure. When heat is applied to the active face of the fabric, the active (composite) fibers contract and reveal the color of the inactive material; this produces a localized visual effect for the purpose of applying customizable patterning through heat.

In FIG. 8C, active fibers 811 are stitched with inactive fibers 821. As illustrated, an active fiber 811 is stitched in an alternating pattern, by forming a back tuck 811*a* followed by a front stitch 811*b*. Inactive fibers are stitched in an alternating pattern, by forming a front tuck 821*a* followed by a back stitch 821*b*. The resulting textile has a column 870 of active fibers with a front stitch 811*b* and inactive fibers with a front tuck 821*a*. The resulting textile also has a column 880 of active fibers with a back tuck 811*a* and inactive fibers with a back stitch 821*b*. The two columns 870 and 880 are alternating in sequence. The knit structure of FIG. 8C can be used to selectively reveal an underlying layer, such as an underlying layer of another material that can be of a different color. A wide variety of alternatives patterns can be stitched, and the stitching need not be in rigid patterns. In some instances, adjacent columns of stitches can be identical; in some instances, adjacent columns of stitches need not be identical.

An increase in temperature can cause axial and helical expansion of fibers, particularly in the case of multi-component fibers causing spiral yarns to increase in loft due to moisture absorption. Similarly, activation energies can cause curling/twisting behaviors in a fiber whereby a straight element is then curled/twisted/folded when subject to moisture or temperature. Finally, a fiber can shrink or expand when subjected to an activation energy.

In some embodiments, first and second yarns are knit in an alternating arrangement. (e.g., a first yarn, then a second yarn, then a first yarn, then a second yarn, etc.). In other embodiments, pairs of first and second yarns are knit in an alternating arrangement (e.g., two first yarns, then two second yarns, then two first yarns, then two second yarns, etc.).

In some embodiments, a knit structure is formed of yarn of composite fiber. The composite fibers can include a pigment in one of the polymers, but do not need to include a pigment in one of the polymers. The composite yarn is applied to one side of the fabric with alternating rows of S and Z twist to form a two-sided fabric with the composite alternating condition applied to one fabric face.

Fabric Activation

The type, amount and location of the environmental activation stimulus to the active textile can create different transformation characteristics based on the pattern and amount of active material. The textile material without the active fiber should not respond to environmental change, and only the active fibers will cause local transformation based on the structure of the knit and amount of active fibers. If the entire textile structure is created with heat-active fibers, the entire textile or zone may transform. However, if the activation energy is applied in a precise and local pattern, then a smaller local transformation may occur. This demonstrates that the location of the active material within the overall garment construction has a direct impact on the type and results of transformation. Similarly, the amount of activation will cause different transformation characteristics. For example, if more energy is applied in a short amount of time it may speed up the transformation, depending on the active material's characteristics. The knit textile can contain zones with different material compositions or knit structures that amplify or constrain the types of transformation. This zonal design can be created based on the specific user or more generally designed for different regions of any garment. The location and type of active material based on the supplied activation energy allows for many different transformations with different activation energies at different times, and can be designed specifically for the application and environment of use.

Usage

The method incorporates bi-directional material shape change into knit garments to extend garment comfort. An embodiment allows for precise control over transformations in a textile garment—either uniformly across the garment or applied in specific zones of a garment. This method produces predictable and precise transformations from a traditionally passive, flat, textile, opening new opportunities for autonomously responsive garments that adapt to changing environmental conditions.

Climate-Responsive Garments: An embodiment enables fabric to fluctuate between different physical states in order to maximize garment comfort, applicable to situations in which the wearer encounters more than one climatic environment throughout the day while wearing the same garment. The ability of the fabric to actively respond to the environment is especially advantageous when indoor and outdoor environments have different temperatures or levels of humidity, enabling an extension of garment comfort throughout the day. For example, the garment can decrease its thermal insulation when moving into a warmer environment from a cooler one, or increase its porosity in response to an increase in temperature or humidity. Finally, the active material in the garment can modulate the surface area of contact between the skin and the garment as the user encounters different climatic environments.

Protective Garments for Extreme Conditions: Principles of active material and knit structures also apply to comfort in extreme thermal conditions, such as for safety or protective layers for contact with extreme heat or cold. These conditions include an increase in fabric thickness or decrease in fabric porosity with significant temperature change, such as for protection from fire or handling of cold substances where it is advantageous for the fabric to hold less bulk at times when the garments are not in contact with extreme temperatures.

Body-Mapped Moisture/Heat Ventilated Garments: An application of this process may include the translation of thermal body mapping to a personalized garment that reflects the user's unique heat signature thereby allocating the right knit structure in the right zone. Closed or open pores, or active and non-active regions can be controlled based on the thermal and moisture variability of different areas of the user's skin surface.

Advantages & Improvements over Existing Methods: Embodiments described herein offer significant advantages over traditional static textiles. Today's garments are designed for single-environments and use-cases. For example, a user may need to add a second layer or a jacket if the user is cold. Or, the user may need to change his or her clothes upon becoming too hot, putting on a lighter more breathable garment. Similarly, clothes are not designed to be worn from one use-case to another like transitioning from biking to work, worn through the work-day, and then at the gym in the afternoon. An embodiment allows a garment to autonomously transform its design and functionality, creating more breathable, comfortable and climate-controlled garments, as the person's activity or the environment changes around him or her.

Typically, "smart garments" today are only possible through electromechanical activation adding cost, complexity, failure-prone components, weight and battery requirements. Electronic smart garments are becoming increasingly popular; however, they have a number of limitations that do not make them widely functional or applicable for everyday use. An embodiment allows for the creation of smart garments that do not add any physical components, electronics, actuators or battery-requirements. Garments described herein can be manufactured in the same way as traditional textile garments, they can be worn and washed in the same way, however, they now have entirely new functionality that allows them to adapt and make the user more comfortable in ever-changing daily use-cases and environmental fluctuations.

Applications

Sports & Performance: Self-transformation process for tunable temperature regulation; Self-transformation process for tunable compression garments.

Medical & Health: Self-transformation process for tunable compression garments

Fashion: Custom-shape/style of the garment based on the user's activation or the setting/environment where it is being worn.

Furniture & Interior Products: Bi-directional transformation of textiles for temperature/comfort control.

Safety: Self-transformation process for textile garments that can protect against high-heat or fires by changing porosity and thickness.

EXAMPLES

Example 1

Trials of Different Cross-Sections

Figure 2A:
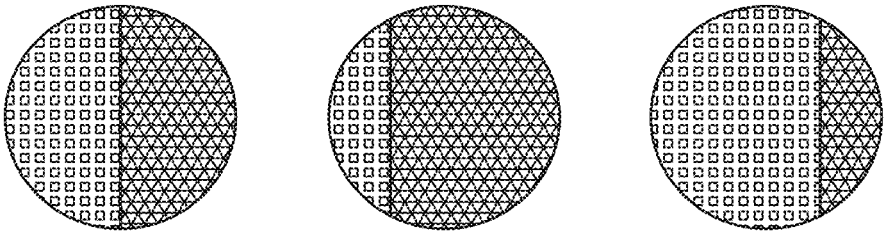
FIGS. 2A-B illustrate cross-sections of several composite fibers.

FIG. 2A illustrates three different compositions for the fiber cross-sections. In each fiber, the material on the left is polypropylene (PP), and the material on the right is polyethylene terephthalate (PET). Dark colored pigment (Ampacet 49419) is added to the PET. The image on the left shows a cross-section that is 50% PP and 50% PET. The image in the middle shows a cross-section that is 40% PP and 60% PET. The image on the right shows a cross-section that is 60% PP and 40% PET.

Figure 2B:
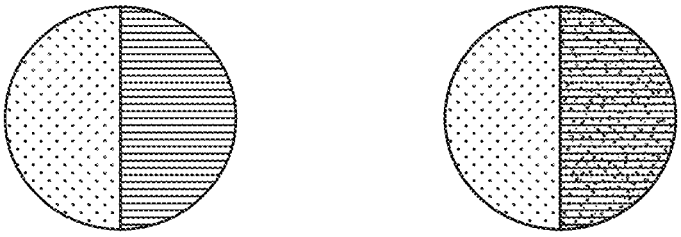
Figure 2B:
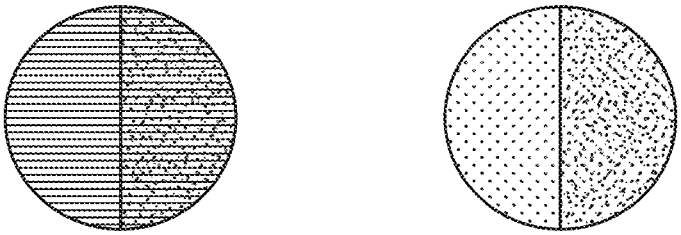

FIG. 2B illustrates four different compositions for the fiber cross-sections, with each fiber being 50% of each of the two polymers. Trial 2, left image is a composite fiber of polyamide 6 (PA6) and linear low-density polyethylene (LLDPE). Trial 2, right image is a composite fiber of PA6 and LLDPE, wherein the LLDPE includes a dark colored pigment (Ampacet 49419). Trials 3 and 4 both pertain to LLDPE and LLDPE with pigment. Trial 5 is a composite fiber of PA6 and PA6 with pigment.

Testing of Example 1 demonstrated that the cross-section ratio of the two polymers influences the extent of transformation of the composite fibers upon exposure to heat. When the polymer with the dark color pigment was more than 50% of the cross-section, the extent of transformation of the composite fiber was greater than when the polymer with the dark color pigment was 50% of the cross section.

Overview of Examples 2-5

Examples 2-5 pertain to knit swatches of a composite fiber only. The center area of each swatch is jersey knit (which is the area that curls). The border is a "links-links" structure to stabilize the edges.

The same procedure was followed for each of Examples 2-5: the knit samples were cooled to −5° C. (+/−2 degrees), then heated with an infrared bulb until to 30° C. (+/−2 degrees). The temperature is the surface temperature of the knit swatch measured with an infrared thermometer.

The images show the difference in angle of curling between the lowest and highest temperature points.

Black pigment: Ampacet 49419

White pigment: TiO2 Americhem 64275

Example 2

Comparison of Pigmented and Unpigmented Composite Fibers

Figure 10A:
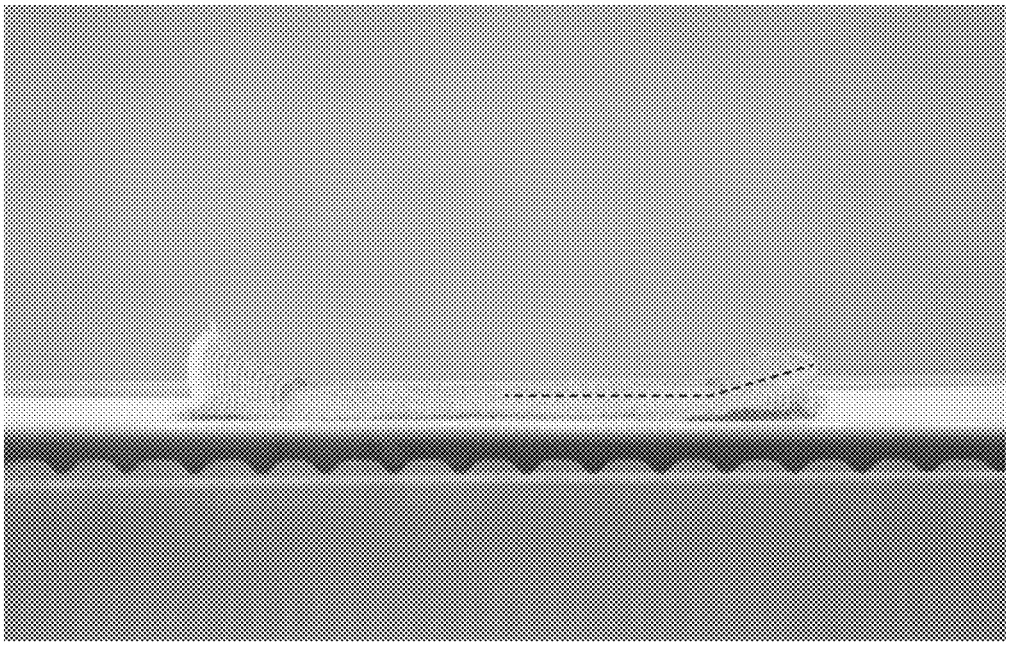
FIGS. 10A, 11A, 12A, 13A, 14A, 15A, and 16A are photographs of knit swatches at −5° C. (+/−2° C.).
Figure 10B:
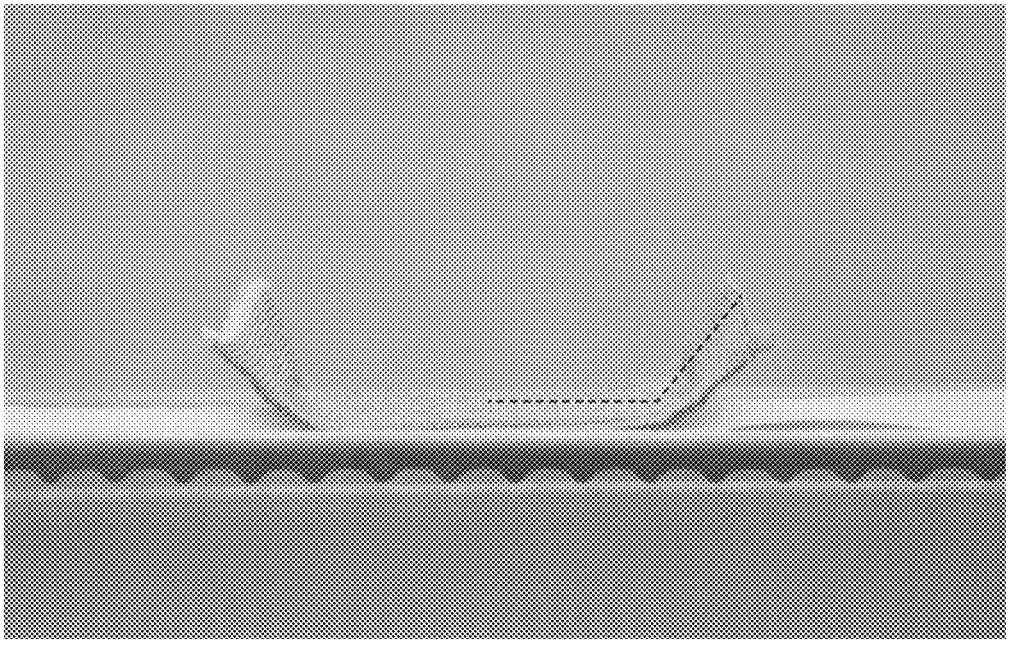
FIGS. 10B, 11B, 12B, 13B, 14B, 15B, and 16B are photographs of knit swatches at 30° C. (+/−2° C.).
Figure 11A:
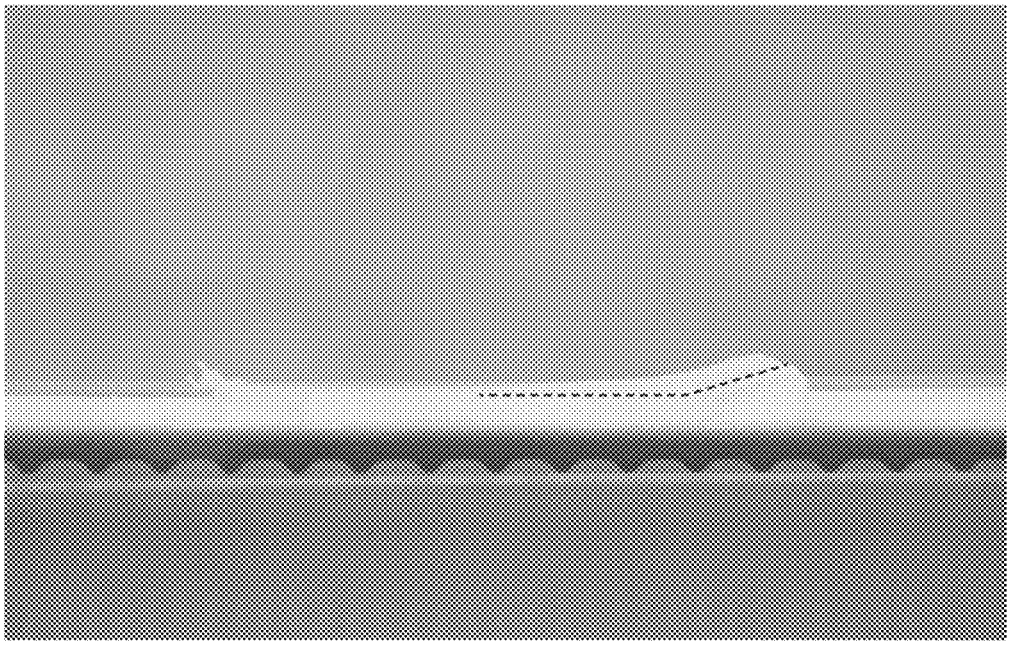
Figure 11B:
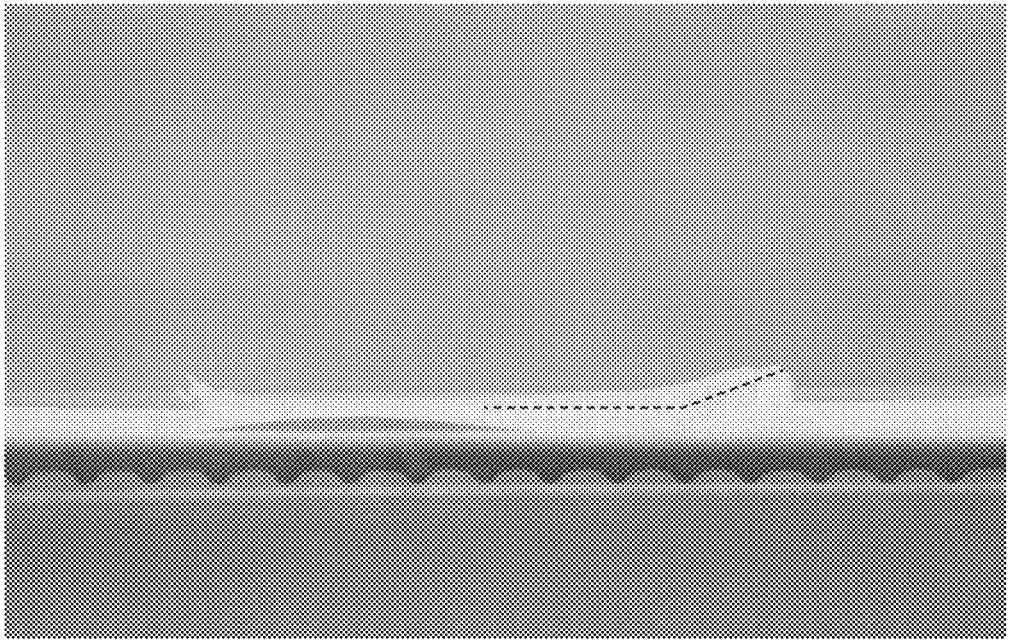

FIGS. 10A-B and 11A-B are photographs of knit swatches. In FIGS. 10A-B, the knit swatches include a composite fiber, wherein the first polymer includes a pigment. In FIG. 11A-B, the knit swatches include a composite fiber, wherein the first polymer does not include a pigment.

Polymer 1: LLDPE+black pigment (FIG. 10A-B) vs. LLDPE+no pigment (FIGS. 11A-B).

Polymer 2: PA6

Cross Section Ratio: 50:50

Untwisted fibers

FIGS. 10A and 11A are photographs of the knit swatches at −5° C. (+/−2° C.).

FIGS. 10B and 11B are photographs of the knit swatches at 30° C. (+/−2° C.).

The change in angle from FIG. 10A to 10B is 34°. The change in angle from FIG. 11A to 11B is 5°.

Example 3

Comparison of Cross-Section Ratio

Figure 12A:
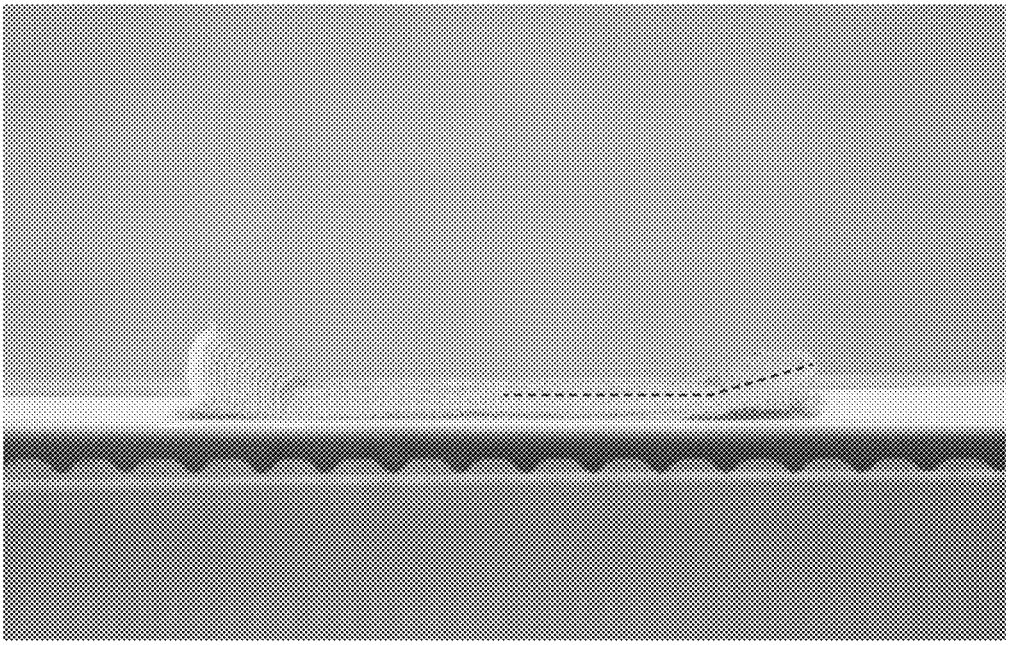
Figure 12B:
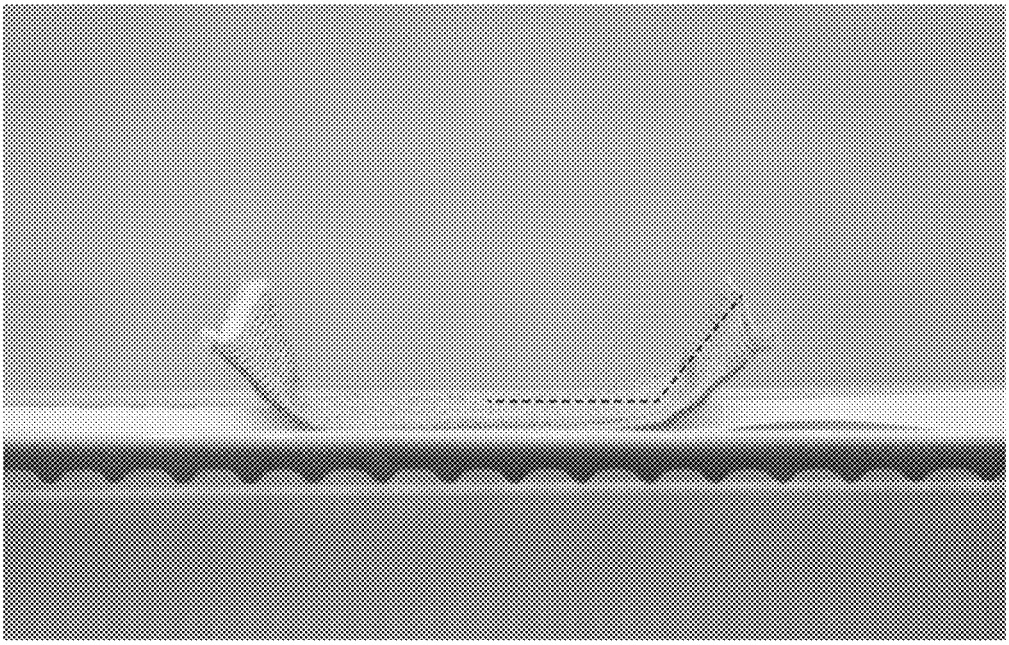
Figure 13A:
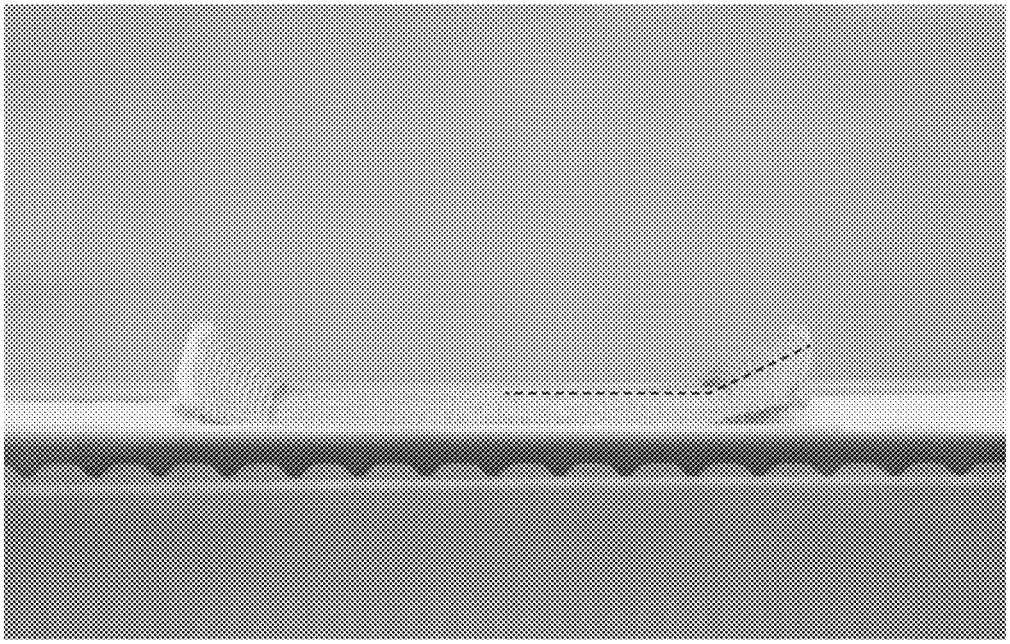
Figure 13B:
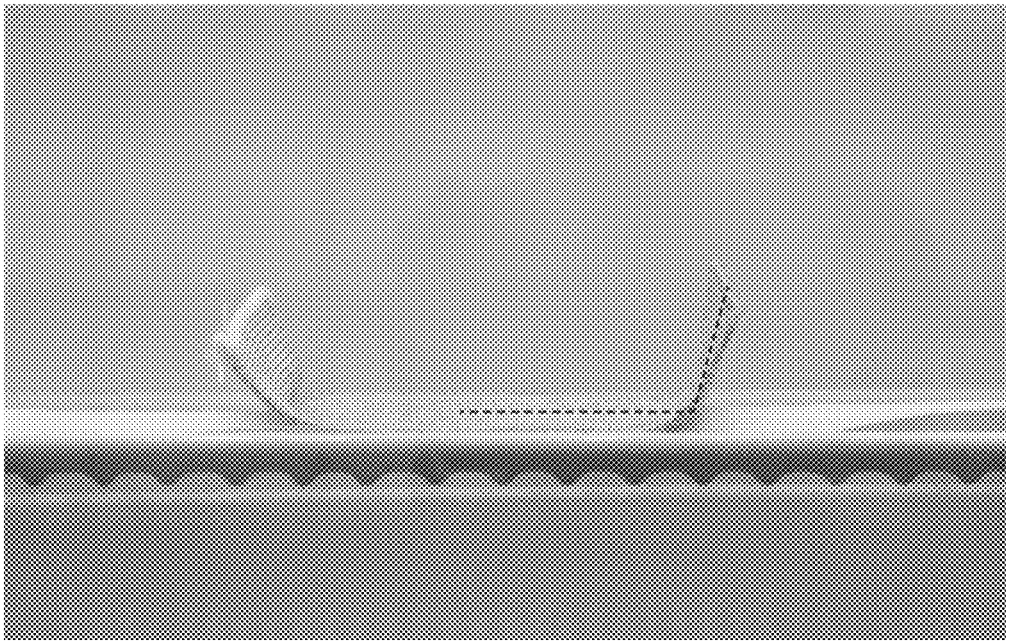

FIGS. 12A-B and 13A-B are photographs of knit swatches. In FIGS. 12A-B, the composite fiber is 50% Polymer 1 and 50% Polymer 2. In FIGS. 13A-B, the composite fiber is 60% Polymer 1 and 40% Polymer 2.

Polymer 1: LLDPE+black pigment

Polymer 2: PA6

Cross Section Ratio: 50:50 (FIGS. 12A-B) vs. 60:40 (FIGS. 13A-B)

Untwisted fibers

FIGS. 12A and 13A are photographs of the knit swatches at −5° C. (+/−2° C.).

FIGS. 12B and 13B are photographs of the knit swatches at 30° C. (+/−2° C.).

The change in angle from FIG. 12A to 12B is 34°. The change in angle from FIG. 13A to 13B is 49°.

Example 4

Comparison of Cross Section Ratio with Alternating Twist Fibers

Figure 14A:
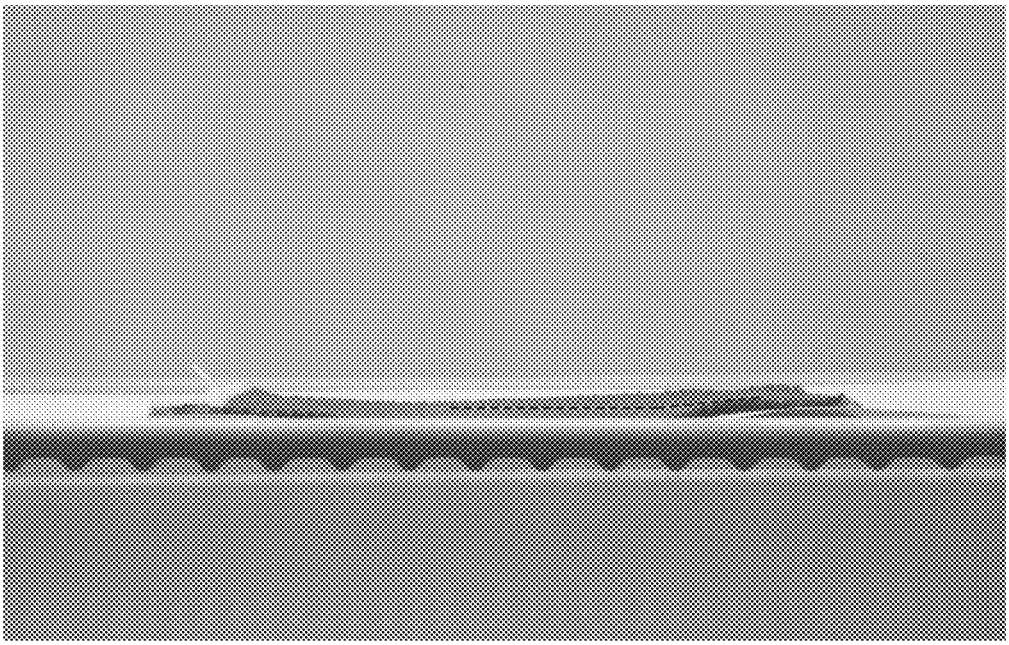
Figure 14B:
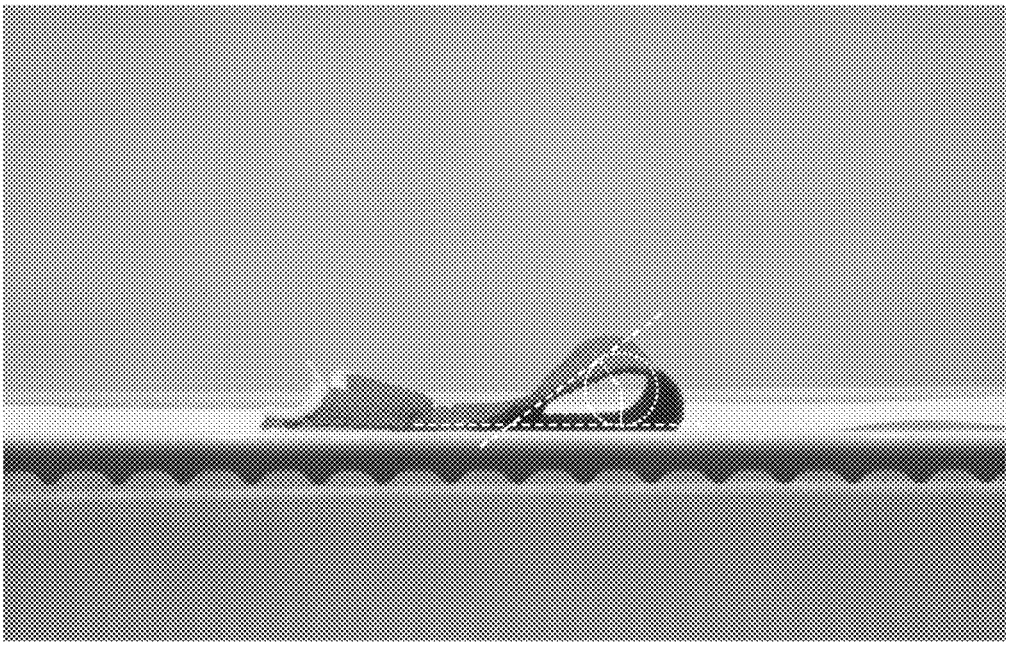
Figure 15A:
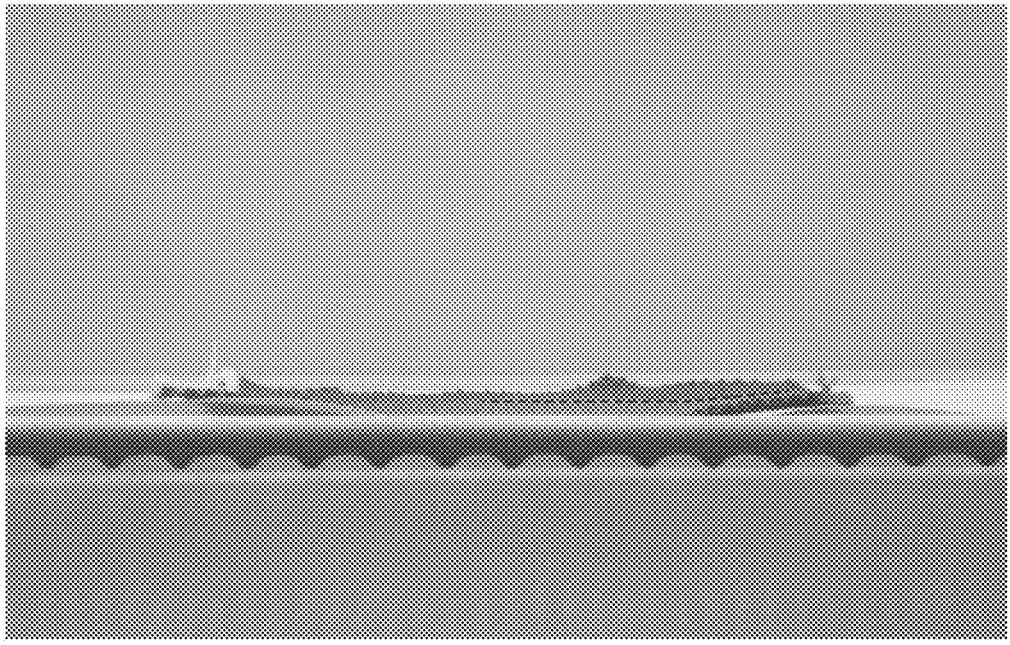
Figure 15B:
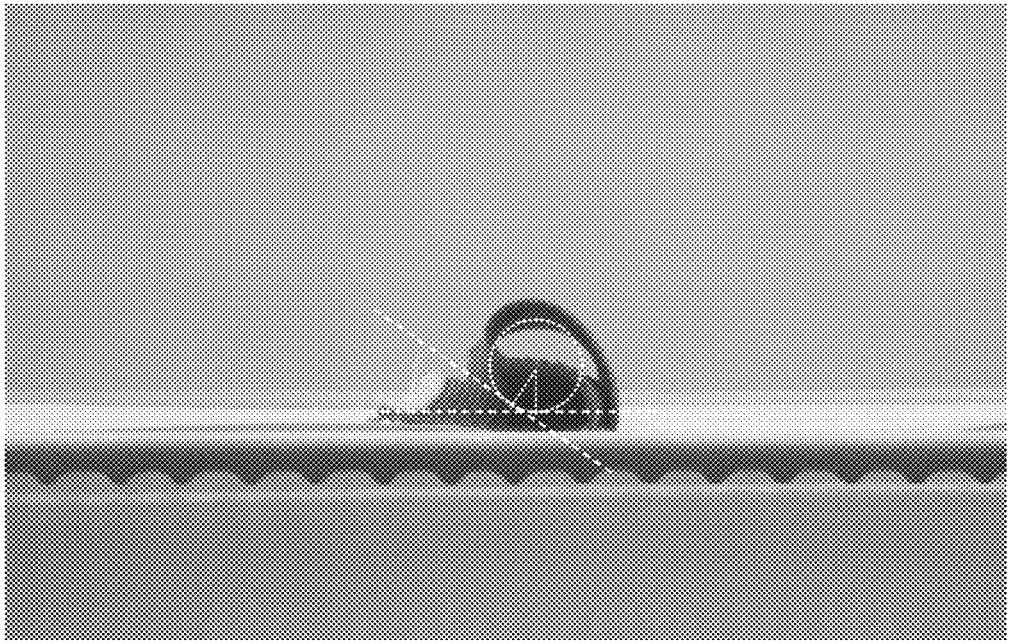

FIGS. 14A-B and 15A-B are photographs of knit swatches. In FIGS. 14A-B, the composite fiber is 80% Polymer 1 and 20% Polymer 2. In FIGS. 15A-B, the composite fiber is 85% Polymer 1 and 15% Polymer 2.

Polymer 1: LLDPE+black pigment

Polymer 2: PP

Cross Section Ratio: 80:20 (FIGS. 14A-B) vs. 85:15 (FIGS. 15A-B)

Alternating S- and Z-twist yarns in knit courses

FIGS. 14A and 15A are photographs of the knit swatches at −5° C. (+/−2° C.).

FIGS. 14B and 15B are photographs of the knit swatches at 30° C. (+/−2° C.).

The change in angle from FIG. 14A to 14B is 228°. The change in angle from FIG. 15A to 15B is 297°.

Example 5

Example of Single-Material Composite Fiber

Polymer 1: LLDPE+black pigment

Polymer 2: LLDPE+white pigment

Cross Section Ratio: 50:50

Untwisted fibers

Figure 16A:
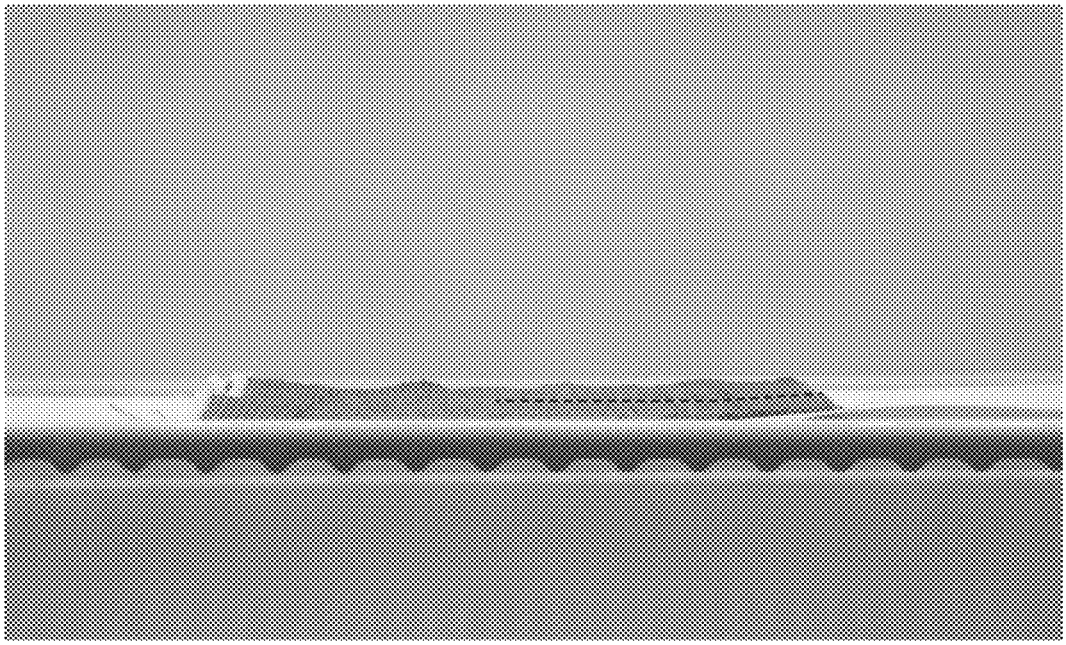

FIG. 16A is a photograph of the knit swatch at −5° C. (+/−2° C.).

Figure 16B:
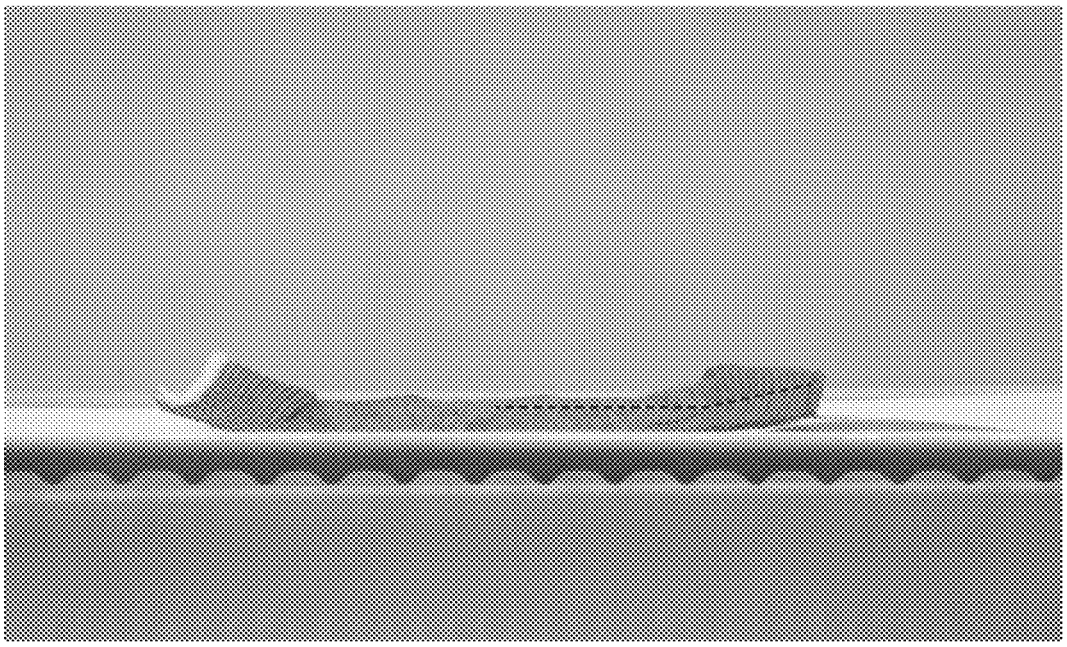

FIG. 16B is a photograph of the knit swatch at 30° C. (+/−2° C.).

The change in angle from FIGS. 16A to 16B is 9°.

Equivalents

While example embodiments have been particularly shown and described, it will be understood by those skilled in the art that various changes in form and details may be made therein without departing from the scope of the embodiments encompassed by the appended claims.

What is claimed is:

1. A knit fabric comprising:

a first and second yarn knit together;

wherein at least one of the first and second yarns comprises a plurality of fibers that are composites of first and second polymers arranged side-by-side in cross-section;

wherein the first polymer comprises a black pigment;

wherein the first and second polymers are polypropylene (PP), polyethylene terephthalate (PET), polyethylene (PE), or polyamide (PA); and wherein the knit fabric curls from 34° to 297° upon exposure to infrared radiation that causes a temperature change from −5° C. to 30° C.

2. The knit fabric of claim 1, wherein the plurality of fibers of the first yarn have an S-twist.

3. The knit fabric of claim 1, wherein the plurality of fibers of the second yarn have a Z-twist.

4. The knit fabric of claim 1, wherein the first and second polymers are the same polymer.

5. The knit fabric of claim 1, wherein the first and second yarns are knit in an alternating arrangement.

6. The knit fabric of claim 1, wherein pairs of the first and second yarns are knit in an alternating arrangement.

7. The knit fabric of claim 1, wherein the first and second yarns are knit together with a third yarn that is not a composite material.

8. The knit fabric of claim 1, wherein the first polymer absorbs more infrared radiation than the second polymer.

9. The knit fabric of claim 1, wherein the second polymer comprises a white pigment.

10. The knit fabric of claim 1, wherein a cross section of the fibers comprise a greater amount of the first polymer than the second polymer.

11. The knit fabric of claim 1, wherein the first and second polymers have linear coefficients of thermal expansion that differ from $1\times10^{-5}$/° C. to $20\times10^{-5}$/° C. at room temperature.

* * * * *